United States Patent [19]

Iwasaki

[11] 4,045,801

[45] Aug. 30, 1977

[54] INK EJECTION HEAD FOR PRINTER

[75] Inventor: Kyuhachiro Iwasaki, Tokyo, Japan

[73] Assignee: Ricoh Company, Ltd., Tokyo, Japan

[21] Appl. No.: 690,130

[22] Filed: May 26, 1976

[30] Foreign Application Priority Data

June 3, 1975 Japan ..... 50-66895

[51] Int. Cl.[2] ..... G01D 15/16

[52] U.S. Cl. ..... 346/140 R

[58] Field of Search ..... 346/140 R, 75

[56] References Cited

U.S. PATENT DOCUMENTS

| | | | |
|---|---|---|---|
| 3,747,120 | 7/1973 | Stemme | 346/140 R X |
| 3,930,260 | 12/1975 | Sicking | 346/140 R |

*Primary Examiner*—Joseph W. Hartary
*Attorney, Agent, or Firm*—Frank J. Jordan

[57] ABSTRACT

Ink is fed into an ink supply chamber communicating through axially aligned orifices with a pressure chamber and an ejection chamber. An ejection orifice or nozzle opens from the ejection chamber toward a copy sheet for printing. An electrical signal fed to an electrostrictive member defining part of the wall of the pressure chamber causes the volume of the pressure chamber to be reduced thereby ejecting ink out of the ejection orifice. The ejection chamber may also be provided with an electrostrictive member to which the electrical signal is also applied.

8 Claims, 3 Drawing Figures

INK EJECTION HEAD FOR PRINTER

BACKGROUND OF THE INVENTION

The present invention relates to an ink ejection head for a printer.

Ink jet printers have been introduced into the art for use in facsimile systems, teletype systems and the like in which droplets of ink are ejected onto a copy sheet to form dots which make up characters or the like. A prior art ink ejection head to which the present invention constitutes a novel improvement comprises a pressure chamber. An electrostrictive member defines part of the wall of the pressure chamber. Ink is fed into an ink supply chamber which communicates with the pressure chamber through an ink supply orifice in such a manner that both chambers are filled with ink. An ink ejection orifice is axially aligned with the ink supply orifice and faces a copy sheet. When an electrical signal is fed to the electrostrictive member, the electrostrictive member deforms to reduce the volume of the pressure chamber. Since the ink is incompressible, an amount of ink equal to the reduction in volume of the pressure chamber is ejected through the ink ejection orifice onto the copy sheet to form a dot.

In order for the ink to be ejected straight outwardly, the orifices must be precisely axially aligned. This is difficult because the orifices must be extremely small, on the order of 10 μm. Such an ink ejection head is therefore expensive to manufacture.

SUMMARY OF THE INVENTION

It is therefore an object of the present invention to provide an ink ejection head which ejects ink straight outwardly and is easier and less expensive to manufacture than prior art ink ejection heads.

It is another object of the present invention to provide an ink ejection head comprising an ink supply chamber communicating through axially aligned orifices with a pressure chamber and an ink ejection chamber, an ink ejection orifice opening from the ink ejection chamber, an electrical signal being applied to an electrostrictive member in the pressure chamber for ink ejection.

Other objects, together with the foregoing, are attained in the embodiments described in the following description and illustrated in the accompanying drawings.

DESCRIPTION OF THE PREFERRED EMBODIMENTS

While the ink ejection head of the invention is susceptible of numerous physical embodiments, depending on the environment and requirements of use, substantial numbers of the herein shown and described embodiments have been made, tested and used, and all have performed in an eminently satisfactory manner.

Figure 1:
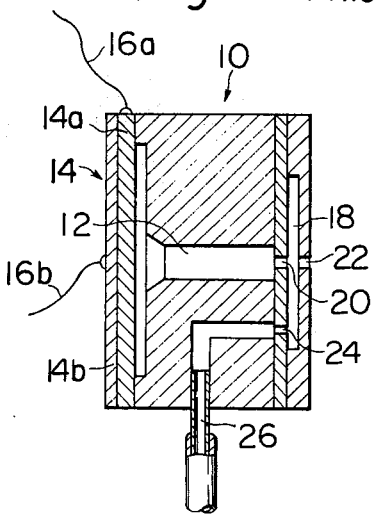
Fig. 1 PRIOR ART
FIG. 1 is a longitudinal section of a prior art ink ejection head to which the present invention is an improvement.

Referring to FIG. 1 of the drawing, a prior art ink ejection head 10 defines a pressure chamber 12 therein. An electrostrictive plate 14 is formed in two layers **14*a* and 14*b*, with the layer 14*a* defining the left wall of the pressure chamber 12. Electrical leads 16*a* and 16*b* are connected to the layers 14*a* and 14*b* of the plate 14 respectively. An ink supply chamber 18 communicates with the pressure chamber 12 through an ink supply orifice 20. An ink ejection orifice 22 is axially aligned with the ink supply orifice 20 and opens rightwardly toward a copy sheet (not shown). The orifices 20 and 22 are very small, on the order of 10 μm, and have substantially the same diameter. An ink inlet 24 communicates through a pipe 26** with an ink reservoir (not shown).

The chambers 12 and 18 are normally filled with ink. Upon application of an electrical pulse signal to the plate 14 through the leads **16*a* and 16*b*, the plate 14 deforms in such a manner that the volume of the pressure chamber 12 is reduced. Since the ink is incompressible, an amount of ink equal to the reduction of volume of the pressure chamber 12 is ejected out of the ejection orifice 22 from the ink supply chamber 18**.

Although this prior art ink ejection head 10 is operable, the orifices 20 and 22 must be precisely axially aligned or the ink will not be ejected straight rightwardly from the ejection orifice 22. Furthermore, this configuration results in generally unstable ink ejection.

Termination of the electrical signal causes the plate 14 to return to its original shape and the volume of the pressure chamber 12 to increase to its original value. This causes ink to be sucked into the supply chamber 18 through the inlet 24. Due to the small size of the ink ejection orifice 22 and the corresponding surface tension and viscous resistance of the ink at the orifice 22, air from outside the ejection head 10 is not sucked into the ink supply chamber 18 through the ink ejection orifice 22.

The drawbacks of the prior art ink ejection head 10 are overcome in an ink ejection head 30 embodying the present invention which defines therein an ink ejection chamber 32. An electrostrictive plate 34 is formed in two layers **34*a* and 34*b*, with the layer 34*a* defining the left wall of the ejection chamber 32. Electrical leads 36*a* and 36*b* are connected to the layers 34*a* and 34*b* respectively. An ink ejection orifice 38 opens rightwardly from the ink ejection chamber 32**.

An ink supply chamber 40 communicates with the ink ejection chamber 32 through an ink supply orifice 42 and with a pressure chamber 46 through a pressure orifice 48. The orifices 42 and 48 are axially aligned with each other and are oriented perpendicular to the ink ejection orifice 38. The ink supply chamber 40 communicates with an ink reservoir (not shown) through a inlet 50 and a pipe 52.

An electrostrictive plate 54 is formed in two layers **54*a* and 54*b*, the layer 54*a* defining the lower wall of the pressure chamber 46. Electrical leads 56*a* and 56*b* are connected to the layers 54*a* and 54*b*** respectively.

In this embodiment, the orifices 42 and 48 are larger than the ink ejection orifice 38, and therefore may be formed much more easily. Also, the axial alignment of the orifices 42 and 48 is much less critical than in the prior art embodiment. Accordingly, the orifice 42 and/or the orifice 48 may deviate from the axis.

In operation, an electrical pulse signal is applied to the plates 34 and 54 through the leads **36*a*, 36*b*, 56*a* and 56*b* respectively, causing the plates 34 and 54 to deform and reduce the volumes of the ink ejection chamber 32 and the pressure chamber 46 respectively. Reduction of the volume of the ink ejection chamber 32 causes ink to be ejected out of the ink ejection orifice 38. Reduction in the volume of the pressure chamber 46 prevents the increased pressure in the ejection chamber 32** from being dissipated.

Upon termination of the electrical pulse signal, the volumes of the ink ejection chamber 32 and the pressure chamber 46 are increased to their original values thereby sucking ink thereinto through the ink supply chamber 40, the inlet 50 and pipe 52. Air will not enter the ink ejection chamber 32 through the ink ejection orifice 38 since the surface tension and viscous resistance at the ink ejection orifice 38 is greater than that at the ink supply orifice 42 since the diameter of the ink supply orifice 42 is greater than that of the ink ejection orifice 38. Also, the fall time of the electrical pulse signal is preferably made longer than the rise time thereof so that the chambers 32, 40 and 46 will be filled relatively gradually.

Figure 2:
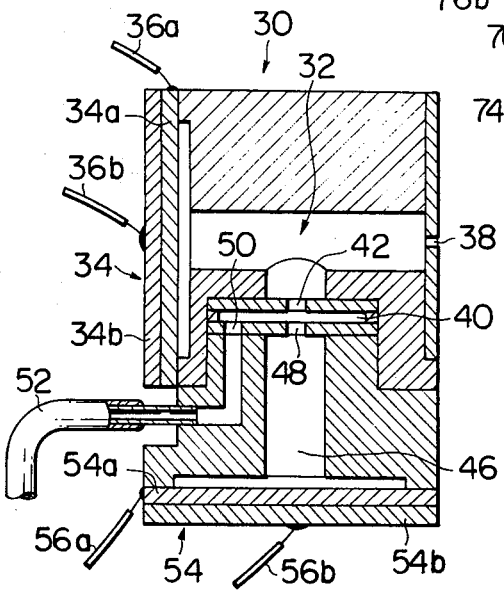
FIG. 2 is a longitudinal section of a first embodiment of the present invention.

It is to be noted that the orifices 42 and 48 may not be limited to that shown in FIG. 2 if the ink ejection chamber is communicated with the pressure chamber 46 so that the reduction in the volume of the pressure chamber 46 prevents the increased pattern in the ejection chamber 32 from being dissipated.

Figure 3:
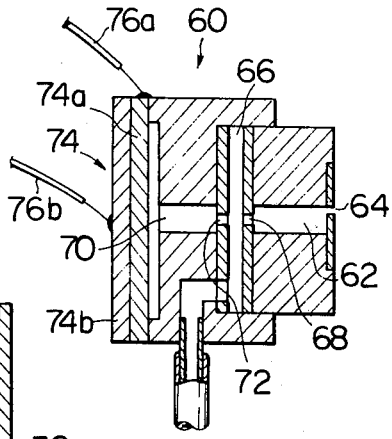
FIG. 3 is a longitudinal section of a second embodiment of the present invention.

A second embodiment of the present invention is illustrated in FIG. 3 and designated as an ink ejection head 60 which defines therein an ink ejection chamber 62. An ink ejection orifice 64 opens from the ink ejection chamber 62. An ink supply chamber 66 communicates with the ink ejection chamber 62 through an ink supply orifice 68 and also with a pressure chamber 70 through a pressure orifice 72. An electrostrictive plate 74 is formed in two layers **74*a* and 74*b*, with the layer 74*a* defining the left wall of the pressure chamber 70. Electrical leads 76*a* and 76*b* are connected to the layers 74*a* and 74*b* respectively. The orifices 78 and 72 are axially aligned with each other and with the ink ejection orifice 64. However, the orifices 68 and 72 are spaced from the ink ejection orifice 64 by the length of the ink ejection chamber 62**.

In operation, an electrical pulse signal which preferably has a magnitude significantly greater than the electrical pulse signal used in the embodiment of FIG. 2 is applied to the plate 74 through the leads **76*a* and 76*b*. The plate 74 deforms to reduce the volume of the pressure chamber 70 and eject ink out through the ink ejection orifice 64. Termination of the electrical pulse signal causes the plate 74 to return to its original shape and increase the volume of the pressure chamber 70 to its original value to suck ink into the chambers 62, 66 and 70. Although proper design of the ink ejection head 60 precludes air from being sucked into the ink ejection chamber 62 through the ink ejection orifice 64, even if air is forced into the ink ejection chamber 62 due to external pressure waves or noise, it will be ejected therefrom through the ink ejection orifice 64** during a subsequent ejection operation.

The present invention provides a configuration in which ink is ejected through an ink ejection orifice from a relatively large ejection chamber due to an increase of pressure in the ink ejection chamber, with ink supply means being isolated from the ink ejection means. It is therefore possible to manufacture the ink ejection head with a relatively low degree of precision and still have stable and straight ink ejection.

What is claimed is:

1. An ink ejection head defining:
an ink ejection chamber;
an ink ejection orifice communicating with the ink ejection chamber;
an ink supply chamber;
an ink supply orifice communicating the ink supply chamber with the ink ejection chamber;
an ink inlet communicating with the ink supply chamber;
a pressure chamber; and
a pressure orifice communicating the pressure chamber with the ink supply chamber;
the ink ejection head comprising means for reducing a volume of the pressure chamber for ink ejection.

2. An ink ejection head as in claim 1 in which the ink supply orifice and the pressure orifice are aligned.

3. An ink ejection head as in claim 2 in which the ink ejection orifice is axially aligned with the ink supply orifice and the pressure orifice.

4. An ink ejection head as in claim 2 in which the ink ejection orifice is oriented perpendicular to the ink supply orifice and the pressure orifice.

5. An ink ejection head as in claim 4 further comprising means for reducing a volume of the ink ejection chamber for ink ejection.

6. An ink ejection head as in claim 1 in which said means comprises an electrostrictive member.

7. An ink ejection head as in claim 5 in which said means for reducing the volume of the pressure chamber and said means for reducing the volume of the ink ejection chamber comprise electrostrictive members respectively.

8. An ink ejection head as in claim 1 in which the ink supply orifice and the pressure orifice are larger than the ink ejection orifice.

* * * * *